United States Patent [19]

Kobayashi et al.

[11] Patent Number: 4,818,919

[45] Date of Patent: Apr. 4, 1989

[54] COLOR PICTURE TUBE APPARATUS

[75] Inventors: Kenichi Kobayashi; Hiroyuki Koba; Naoto Nakamura, all of Fukaya, Japan

[73] Assignee: Kabushiki Kaisha Toshiba, Kanagawa, Japan

[21] Appl. No.: 113,203

[22] Filed: Oct. 27, 1987

[30] Foreign Application Priority Data

Oct. 31, 1986 [JP] Japan ..... 61-258349
Jun. 19, 1987 [JP] Japan ..... 62-151394

[51] Int. Cl.[4] ..... H01J 29/56
[52] U.S. Cl. ..... 315/371
[58] Field of Search ..... 315/371, 368

[56] References Cited

U.S. PATENT DOCUMENTS 4,547,707 10/1985 Yabase ..... 315/368
4,588,930 5/1986 Kobayashi et al. ..... 315/400
4,642,528 2/1987 Kobayashi et al. ..... 315/368
4,704,564 11/1987 Ito et al. ..... 315/368

*Primary Examiner*—Theodore M. Blum
*Attorney, Agent, or Firm*—Finnegan, Henderson, Farabow, Garrett & Dunner

[57] ABSTRACT

A color picture tube apparatus comprises a color picture tube including an envelope having a phosphor screen excited by a plurality of electron beams, and deflection means generating horizontal deflection field and barrel type vertical deflection field for the beams, including non-linear magnetic field correction means generating an additional pin-cushion type magnetic field in the vertical field to have preferably convergence characteristics such that vertical direction coma errors can be appropriately corrected throughout every portion of the vertical axis on the screen, whereby high-definition color images can be obtained thereon.

16 Claims, 8 Drawing Sheets

COLOR PICTURE TUBE APPARATUS

BACKGROUND OF THE INVENTION

This invention relates generally to a color picture tube apparatus, and more particularly, to a color picture tube apparatus provided with a deflection system that corrects the aberration of vertical magnetic deflection by which plural electron beams are influenced, and an in-line type electron gun.

In general, a color picture tube is provided with a screen inside the panel of an evacuated envelope, to which phosphors of three separate sets are uniformly applied in a stripe shape or in a dot shape, and the respective phosphors emit a red, green or blue light, respectively.

Three electron guns are provided corresponding to such phosphors of three colors, and three electron beams discharged by the three electron guns are caused to impinge through a large number of apertures of a color-selection electrode, i.e., shadow mask, on the corresponding phosphors, which, in turn, are excited. During the passage of the electron beams, horizontal and vertical deflection magnetic fields deflect these electron beams so as to scan the screen.

However, the rasters drawn by scanning of these electron beams are not converged on the screen due to the following reasons.

(a) Because the respective electron beams are discharged from the electron guns which are disposed at separate different positions, each of beams pass through different positions in the deflection magnetic field. Thus the amounts of deflection that the respective electron beams undergo are different.

(b) The distance between the center of deflection and the screen does not coincide with the radius of curvature of the screen.

The most simplified configurations to cause the rasters to coincide with each other use a plurality of electron beams in an in-line arrangement, and the deflection magnetic fields are non-uniform. Specifically, a pin-cushion type horizontal deflection magnetic field and a barrel type vertical deflection magnetic field are used. With this design, the rasters of the side electron beams substantially can be converged. However, the rasters of the side electron beams do not converge on the rasters of the center electron beams. Specifically, the rasters of the center electron beams become smaller than the rasters of side electron beams. The difference in size between the center and side beam rasters is called a coma error, and in the case of 14-inch type color picture tube, both a vertical direction coma error (VCR) and a horizontal direction coma error (HCR) occur on the order of 1 to 2 mm. In order to correct this difference so as to automatically converge the rasters (self convergence), magnetic pieces have been disposed on the side of the deflection magnetic field to locally adjust the magnetic field. This configuration was disclosed in U.S. Pat. No. 3,860,850 issued to Takenaka et. al.

However, the requirements for high definition of the screen necessitate the increase of the horizontal deflection frequency, and an apparatus provided with a horizontal deflection frequency of as high as 64 kHz, four times the frequency of the conventional TV apparatus, has been practically used. In this case, the above-described configuration that employs the magnetic pieces cannot sufficiently adjust the magnetic field because of losses within the magnetic pieces caused by the increase of the deflection frequency. When such magnetic pieces are omitted, the horizontal direction coma error (HCR) can be reduced by improving the distribution of horizontal deflection coils, however, the correction of the vertical direction coma error (VCR) is more difficult.

As a result of this, a sub-coil for use in correction has been attached in place of the magnetic pieces on the main vertical deflection coil, (as described in Japanese Utility Model Publication No. 57-45748). In this case, a pair of sub-coils coiled around a U-shaped core are disposed between the pointed end of the electron gun of the picture tube and the front side of the main deflection coil in such a manner that they oppose each other in the vertical direction. The magnetic fields generated by these sub-coils are of pin-cushion type, and are superimposed on the vertical deflection magnetic field. With the sub-coils, the coma error of the vertical direction can be reduced to approximately 0.2 mm in the case of a 14-inch type color picture tube, but cannot be completely eliminated. This means that the rasters at the intermediate portion of the screen undergo locally excessive correction. Even small coma errors of such extent as described above can develop shear in color that causes color distortion with respect to the characters displayed on the screen in the case of a high-definition color picture tube for use in a computer display and the like.

SUMMARY OF THE INVENTION

Accordingly, one object of this invention is to provide a color picture tube apparatus in which aberrations of the vertical magnetic deflection are reduced, and a preferable convergence is obtained with plural electron beams.

Briefly, in accordance with one aspect of this invention, a color picture tube apparatus comprises a color picture tube including an envelope having a panel therein, a phosphor screen inside the envelope, and an electron gun generating a plurality of electron beams for exciting the phosphor screen to emit light and deflection means.

The deflection means generates horizontal and vertical deflection magnetic fields for deflecting the electron beams and forming rasters on the screen, including means for generating a barrel type vertical deflection magnetic field, and non-linear magnetic field correction means generating an additional pin-cushion type magneitc field for vertically adjusting the the position of rasters on the screen.

In more detail, the color picture tube apparatus comprises a color picture tube including an envelope having a panel, a phosphor screen provided inside the panel of said envelope, and an in-line type electron gun generating a plurality of electron beams for exciting said phosphor screen to emit light;

deflection means includes means for generating magnetic fields that deflect the electron beams in a horizontal direction and in a vertical direction and for generating a pin-cushion type horizontal deflection magnetic field, and means for generating a barrel type vertical deflection magnetic field;

deflection magnetic field correction means for generating a correction magnetic field and for adding the correction magnetic fields for aligning said electron beams in the vertical direction;

means for supplying a deflection current to each of the deflection means and the deflection magnetic field correction means; and means for nonlinearly adjusting the current in correction means in accordance with the deflection current in the vertical direction.

BRIEF DESCRIPTION OF THE DRAWINGS

FIG. 6A illustrates a vertical deflection magnetic field, FIG. 6B a correction magnetic field of first sub-coils, and FIG. 6C a correction magnetic field of second sub-coils, respectively;

DETAILED DESCRIPTION OF PREFERRED EMBODIMENTS

Figure 1:
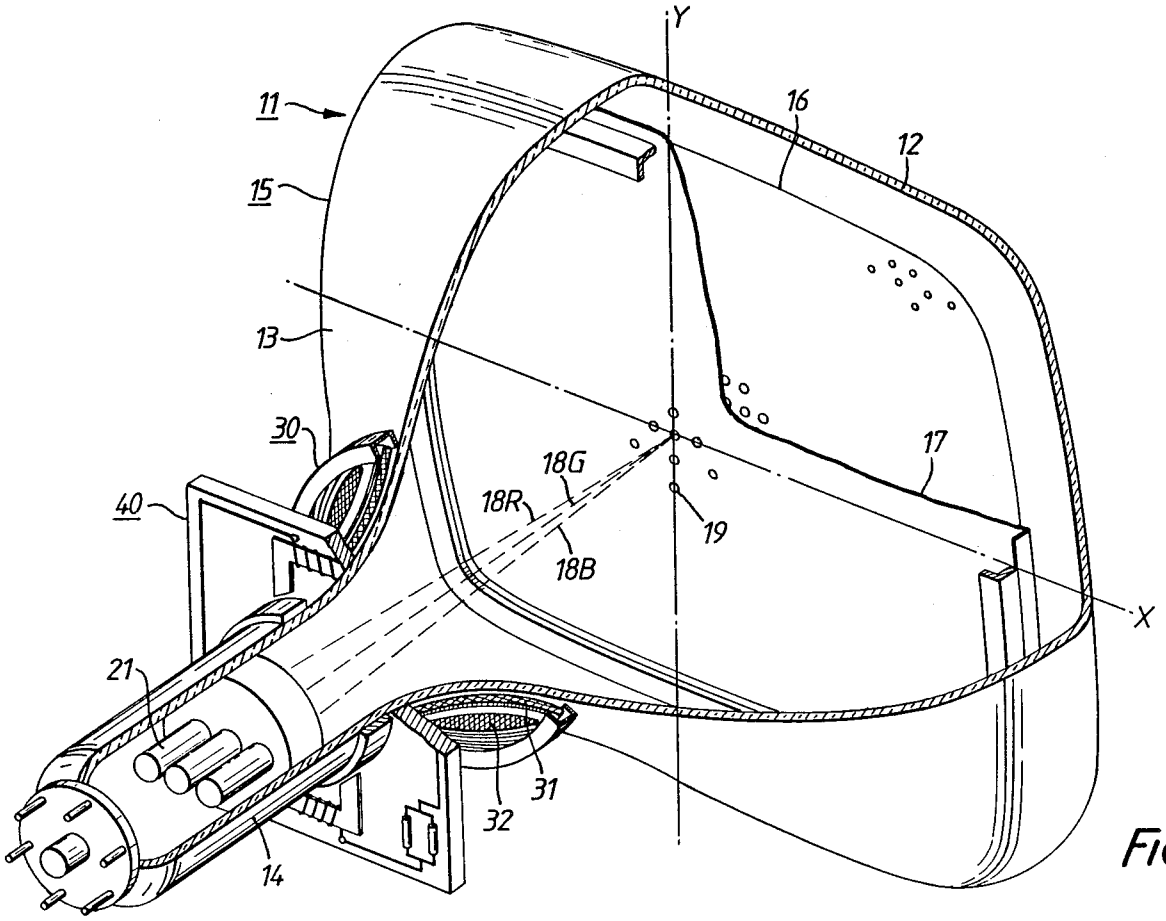
FIG. 1 is a partially cutaway perspective diagram illustrating one embodiment of the present invention.

Referring now to the drawings, wherein like reference numerals designate identical or corresponding parts throughout the several views, and more particularly to FIG. 1 through FIG. 6 thereof, one embodiment of this invention will be described.

Figure 2:
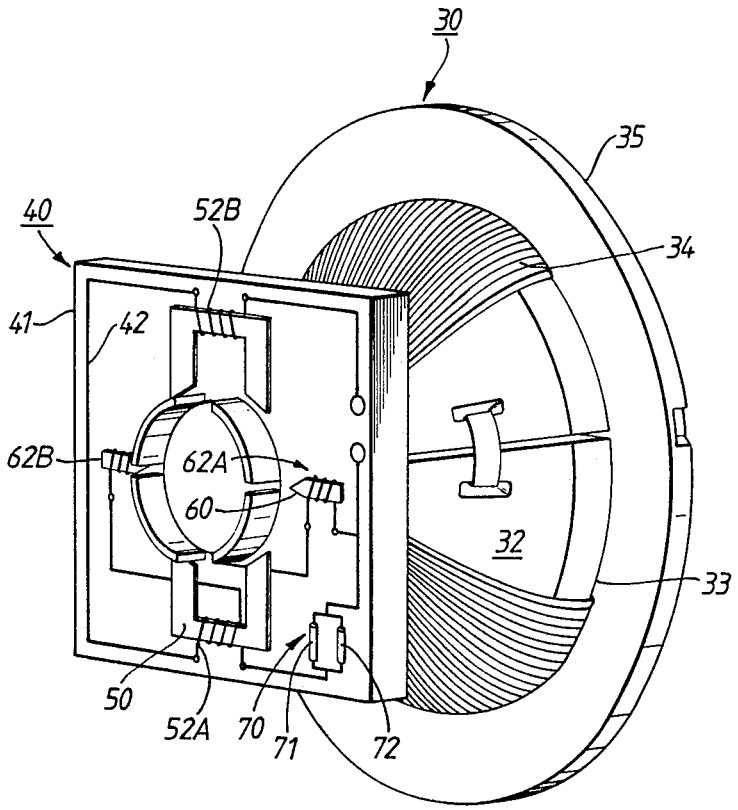
FIG. 2 is a perspective diagram illustrating an enlarged principal part of FIG. 1.

In FIG. 1, a color picture tube 11 is provided with a glass envelope 15 that forms a transparent panel 12 in the front face thereof, and comprises a funnel 13 and a neck 14. Inside panel 12 is provided a phosphor screen 16 having phosphors that emit three different colors such as red, green and blue, and these phosphors are uniformly and alternately deposited thereon in a dot fashion. A shadow mask 17 is mounted close by screen 16, and within neck 14 an in-line electron gun 21 that generates three separate electron beams 18R, 18G and 18B is incorporated. These three electron beams are generated in a line with equidistance spaced on the horizontal plane that includes the horizontal axis X passing through the center of screen 16 on the tube axis. The reason for this is that an in-line type electron gun is used. Here, the Y axis represents the vertical axis. The electron beams are generated so as to be converged on a central point on screen 16. Thereafter, the beams pass through one of a large number of apertures of shadow mask 17, and then impinge on screen 16 so as to cause the respective color phosphors to be excited and emit light. A deflection apparatus 30 is disposed outside neck 14, such that the electron beam passages are surrounded. Deflection apparatus 30 includes a saddle type horizontal deflection coil 31 that generates horizontal deflection magnetic fields, and a toroidal type vertical deflection coil 32 that generates vertical deflection magnetic fields. As shown in FIG. 2, the vertical deflection coil 32 includes a wire coil 34 coiled around a ferrite core 33. The coil 32 is integrated together with a horizontal deflection coil 31 by use of a mold 35.

In FIG. 2, a deflection magnetic field correction apparatus 40 is attached to the electron gun side of the mold 35. A printed circuit board 41 of the deflection magnetic field correction apparatus 40 is formed by a frame member provided with a hole such that the neck 14 passes through at the center thereof. In the vertical direction, i.e., on the upper and lower sides of the printed circuit board 41 as oriented in FIG. 2, a pair of first sub-coils 52A and 52B are provided. Each of these sub-coil is coiled around a U-shaped core 50. In the horizontal direction, i.e., on the right and left sides of printed circuit board 41, a pair of second sub-coils 62A and 62B are provided. These sub-coils are coiled around a pair of rod-shaped cores 60. On the lower side of printed circuit board 41, a current control element 70, including a pair of diodes 71 and 72 connected in inverse-parallel, is attached. The current control element 70 is connected to the sub-coils by way of printed lines 42 on printed circuit board 41.

Figure 3:
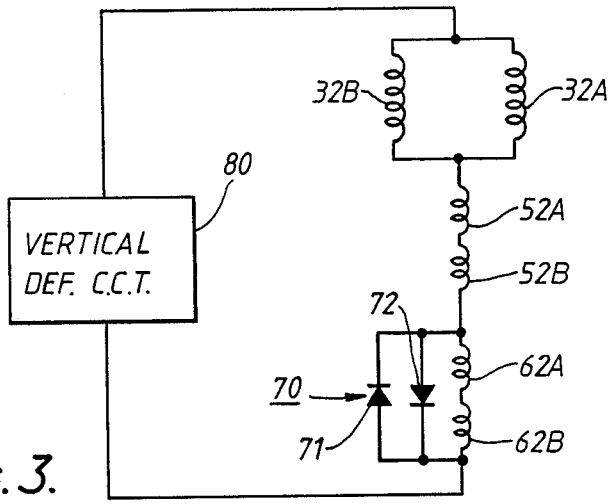
FIG. 3 is a circuit diagram illustrating a deflection system of the embodiment shown in FIG. 1.
Figure 4:
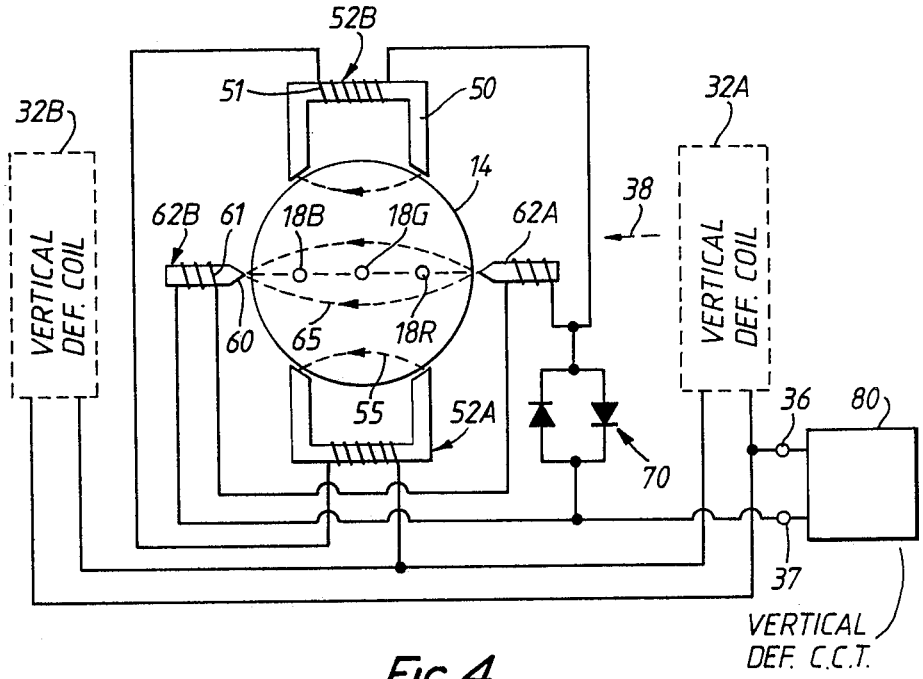
FIG. 4 is a diagram of component configuration for explaining the operation of the deflection system of the embodiment shown in FIG. 1.

The operations of the deflection apparatus 30 and the deflection magnetic field correction apparatus 40 will be described with reference to the circuit diagram of FIG. 3 and the component configuration of FIG. 4. In FIG. 4, a circle represents the neck 14 of the picture tube 11 on a vertical plane through the sub-coil position as observed from the screen side. Three separate electron beams 18R, 18G and 18B pass through the neck 14. As shown in FIG. 3, a series circuit of the parallel-connected vertical deflection coils 32A and 32B, the series-connected first sub-coils 52A and 52B, and the series-connected second sub-coils 62A and 62B is provided. Current control element 70 is connected across the series-connected sub-coils 62A and 62B. One end 36 of vertical deflection coils 32A and 32B and one end 37 of sub-coil 62B are each connected to a vertical deflection circuit 80. In FIG. 4, the vertical deflection magnetic field is a barrel-type non-uniform field 38, and is formed such that the magnetic flux is directed in the arrow-marked direction. The distribution of coil 34 coiled around ferrite core 33 determines whether the vertical deflection magnetic field is of a uniform magnetic field type or of non-uniform (such as barrel type) magnetic field type. Also, in the case of the saddle type coil, the magnetic field can similarly be determined. The first sub-coils 52A and 52B form a pin-cushion type magnetic fields, such as the magnetic flux 55. The second sub-coils 62A and 62B form a barrel type magnetic field, such as the magnetic flux 65. These magnetic fields are added to the vertical deflection field.

Figure 5:
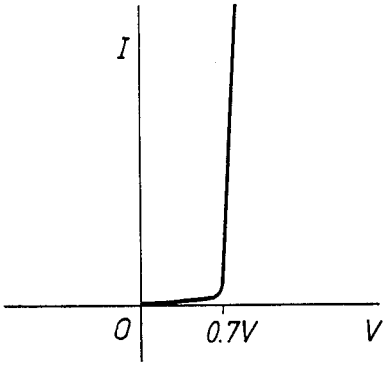
FIG. 5 is a graph illustrating characteristics of a current control element in the circuit shown in FIG. 3.

Specifically, the first sub-coils 52A and 52B generate pin-cushion magnetic fields of the same direction as that of the main deflection magnetic field, so as to perform a positive correction, while the second sub-coils 62A and 62B generate barrel-type magnetic fields of the same direction as that of the main deflection magnetic field, so as to perform a negative correction. Further, the current control element 70 connected in parallel with the second sub-coils 62A and 62B utilizes a pair of diodes connected in inverse-parallel. FIG. 5 shows the forward current-voltage characteristics of the diodes, such that in the case of silicone diodes, for example, when the voltage V reaches approximately 0.7 volt, the current I rapidly rises. Thus the vertical deflection current that flows into the second sub-coils 62A and 62B from the vertical deflection circuit 80 becomes constant after the starting point corresponding to the rising portion of the diode current. Thus, the magnetic field 65 generated by the second sub-coils 62A and 62B becomes constant, and the negative correction of the vertical direction coma error (VCR) becomes saturated.

For example, in the 14-inch type color picture tube of 90-degree deflection, the electron beams are deflected, in terms of vertical deflection angle, from the tube axis toward the vertical axis Y direction within +30 degrees. In this embodiment, the relative operations of the first and second sub-coils change depending on the range of deflection angles between 0 to 15 degrees and between 15 to 30 degrees.

(a) Within 15 degrees:

The vertical deflection current that flows into the series circuit of the main deflection coil 32, the first sub-coils 52A and 52B, and the second sub-coils 62A and 62B increases in a substantially proportional manner. The first sub-coils 52A and 52B form the pin-cushion magnetic field 55, and the second sub-coils 62A and 62B form the barrel type magnetic field 65, so that they cancel each other. However, the magnetic field 55 generated by the first sub-coils 52A and 52B is greater than the magnetic field 65, whereby as a whole, the substantially proportional VCR correction is performed.

(b) In the range of 15 to 30 degrees:

The deflection current that flows into the main vertical deflection coil 32 and the first sub-coils 52A and 52B increases proportionally.

Meanwhile, the current that flows into the second sub-coils 62A and 62B becomes constant, so that the correction magnetic field becomes greatly influenced by the pin-cushion magnetic field generated by the first sub-coils 52A and 52B. Consequently, this serves to weaken the barrel-shape of the main deflection magnetic field in the vicinity of the upper and lower sides of the screen.

Figure 6A:
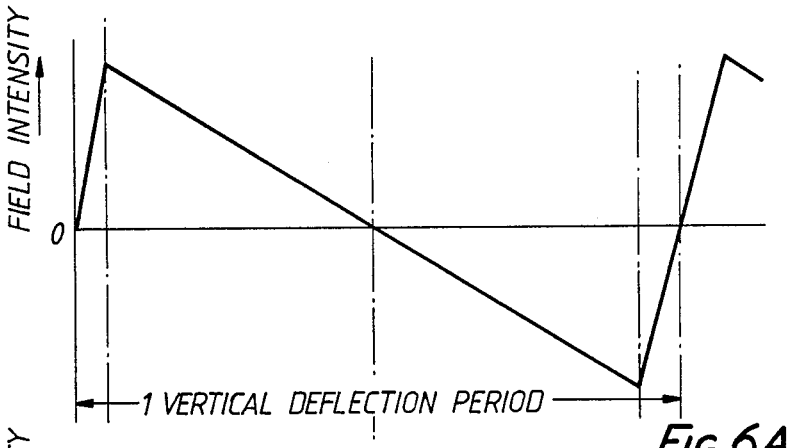
FIG. 6A, 6B and 6C are waveform diagrams illustrating the intensities of deflection magnetic field during one period of the vertical deflection for explaining operations of the deflection system shown in FIG. 3.
Figure 6B:
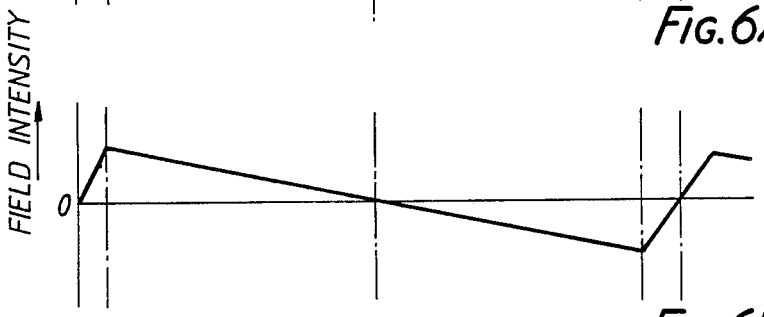
Figure 6C:
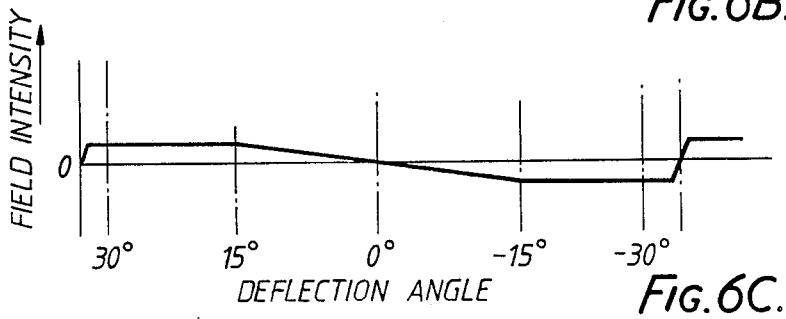

FIGS. 6A, 6B and 6C show the respective field intensities of the magnetic fields generated by the main vertical deflection coils 32A and 32B, the first sub-coils 52A and 52B, and the second sub-coils 62A and 62B, with respect to the vertical deflection period. Here, the main vertical deflection magnetic field 38 and the positive correction magnetic field 55 generated by the first sub-coils 52A and 52B are changed in proportion to the sawtooth-shaped vertical deflection current. On the other hand, the negative correction magnetic field 65 generated by the second sub-coils 62A and 62B is saturated in the region more than a certain specified constant deflection magnetic field by virtue of the characteristics of the current control element 70. The combination of the positive correction generated by the first sub-coils 52A and 52B and the negative correction, which saturates in the specified region, generated by the second sub-coils 62A and 62B functions to eliminate excessive corrections of the vertical direction coma error (VCR) in the vicinity of the intermediate portion of vertical axis. The starting point of the saturation of sub-coil current is designed to be optimum taking the kinds of diodes and the state of sub-coil windings into consideration. This achieved a reduction of coma errors to less than 0.02 mm, i.e., down to a range causing practically no trouble.

The operation of the first and second sub-coils 52A and 52B, and 62A and 62B will now be described with reference to FIG. 7 and FIG. 8.

Figure 7:
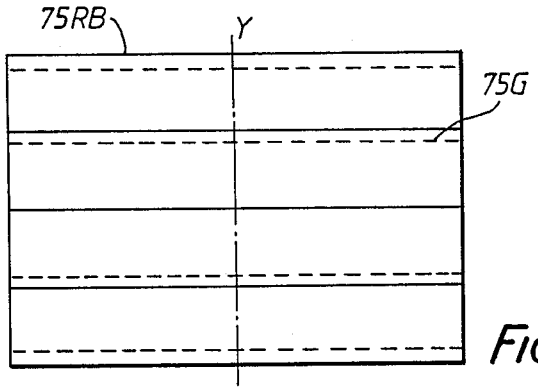
FIG. 7 is a plan view illustrating a raster image prior to correction on the screen.

FIG. 7 shows a raster image which is obtained in a color picture tube with the in-line type electron gun. In this example, the horizontal deflection magnetic field is formed as a pin-cushion type and the vertical deflection magnetic field is formed as a barrel-type and the first and second sub-coils are not operated. In FIG. 7, the green raster 75G generated by the center electron beam is reduced in size compared to the red and blue rasters 75RB generated by the side electron beams. In this raster image, the vertical lines of rasters are appropriately corrected by the optimum winding distribution of the horizontal deflection coils.

Figure 8:
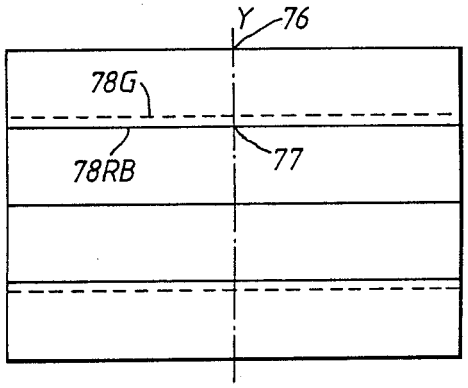
FIG. 8 is a plan view illustrating a raster image in the case of insufficient correction.

FIG. 8 shows a raster image which is obtained when the result of the operation of the first and second sub-coils is added to the result of the operation of the main deflection coils. However, the current control element is not used. Thus, the current that flows into the second sub-coils is not limited. In this operation, should the width of vertical direction of the green raster be caused to converge with the width of vertical direction of the red and blue rasters at the end portion 76 of the vertical axis Y, the green raster 78G becomes expanded at the intermediate portion 77 in comparison with the red and blue rasters 78RB.

Under this condition, according to the embodiment of the present invention, when the current control element 70 is connected across the second sub-coils 62A and 62B so as to cause the current that flows into these sub-coils to become saturated in the region more than the predetermined value of vertical deflection current, the raster image will be substantially completely corrected.

Figure 9:
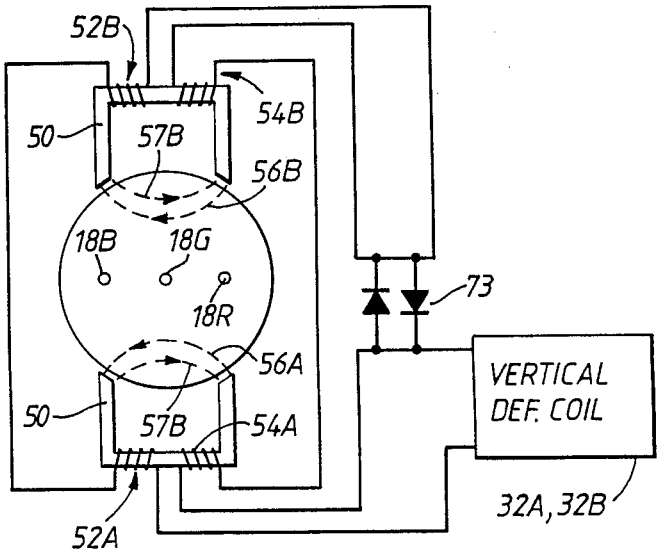
FIG. 9 is a diagram of a component configuration illustrating another embodiment of the present invention.

FIG. 9 shows the second embodiment of the present invention. In FIG. 9, to a U-shaped core 50 of first sub-coils 52A and 52B, there are added coils 54A and 54B that are coiled in the reverse direction with respect to coils 52A and 52B. Even in this configuration, the same advantages as those in the first embodiment can be achieved. Magnetic fields 56A and 56B are generated by the first sub-coils 52A and 52B, and magnetic fields 57A and 57B are generated by the added coils 54A and 54B. A current control element 73 is connected in parallel with the added coils 54A and 54B. The current flowing into the added coils 54A and 54B becomes saturated in the region more than the constant value of vertical deflection current. The added coils 54A and 54B correspond to the second sub-coils 62A and 62B in the first embodiment.

As a further modification, E-shaped cores can also be employed in place of the U-shaped cores, and the E-shaped cores may be disposed in a horizontal direction, i.e., on the right and left sides of the neck, so as to generate a hexagonal-pole magnetic field.

Figure 10:
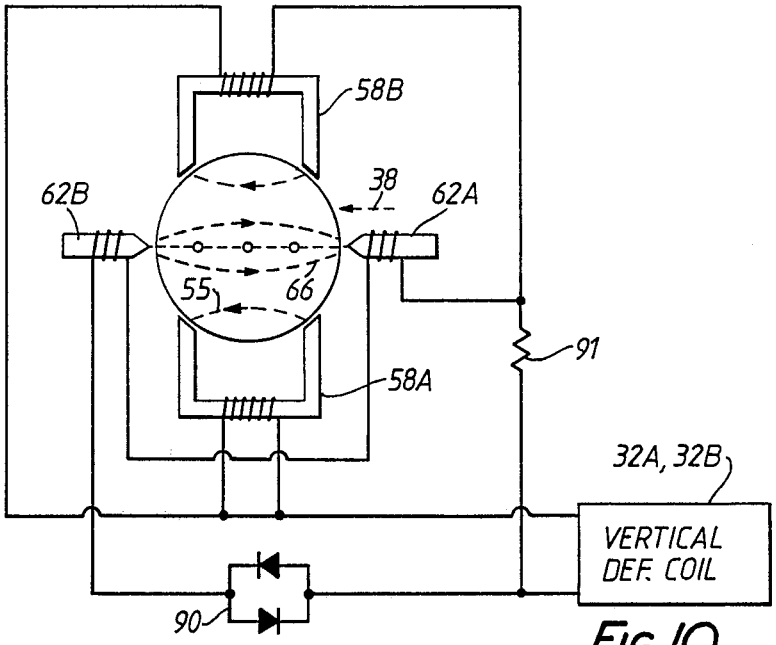
FIG. 10 is a diagram of a component configuration illustrating another embodiment of the present invention.

FIG. 10 shows the third embodiment of the present invention. In FIG. 10, first sub-coils 58A and 58B positioned in a vertical direction generate pin-cushion magnetic fields 55 in a direction identical to that of the magnetic field 38 of the main vertical deflection coil. Second sub-coils 62A and 62B of rod-shaped cores are disposed in a horizontal direction, i.e., on the right and left sides of the neck. The second sub-coils 62A and 62B generate a barrel type magnetic field 66 in a direction opposite to that of the main deflection magnetic field 38. However, both the first and second sub-coils function such that the center electron beams become more greatly influenced by the deflection magnetic field in comparison with the side electron beams, consequently VCR correction can be achieved. Further, a current control element 90 that consists of a pair of diodes connected in inverse-parallel relation is connected in series with the second sub-coils 62A and 62B. Moreover, a current is supplied through a resistor 91 to the second sub-coils 62A and 62B. As the diodes of the current control element 90, silicon diodes with a starting voltage rise of approximately 0.7 volts, are utilized, for example. Therefore, the vertical deflection current that flows into the second sub-coils 62A and 62B increases rapidly, after the voltage across the resistor 91 has reached the above-described starting voltage rise of the current control element 90. Consequently, the VCR correction generated by the second sub-coils 62A and 62B is added to the correction generated by the first sub-coils 58A and 58B, whereby the scarcity of VCR correction in the intermediate portion of the vertical axis Y can be eliminated.

When the VCR correction up to the intermediate portion of vertical axis Y generated only by the first sub-coils and the VCR correction at the end of the vertical axis Y generated by the first sub-coils together with the second sub-coils are combined, an optimum VCR correction at the end of the vertical axis Y can be achieved without any excessive VCR correction at the intermediate portion of the vertical axis Y. The starting point to rise of the current that flows into the sub-coils can be adjusted to obtain the optimum by appropriate selection of such factors as the kinds of diodes, and the sizes and the number of turns of the sub-coils.

Figure 11:
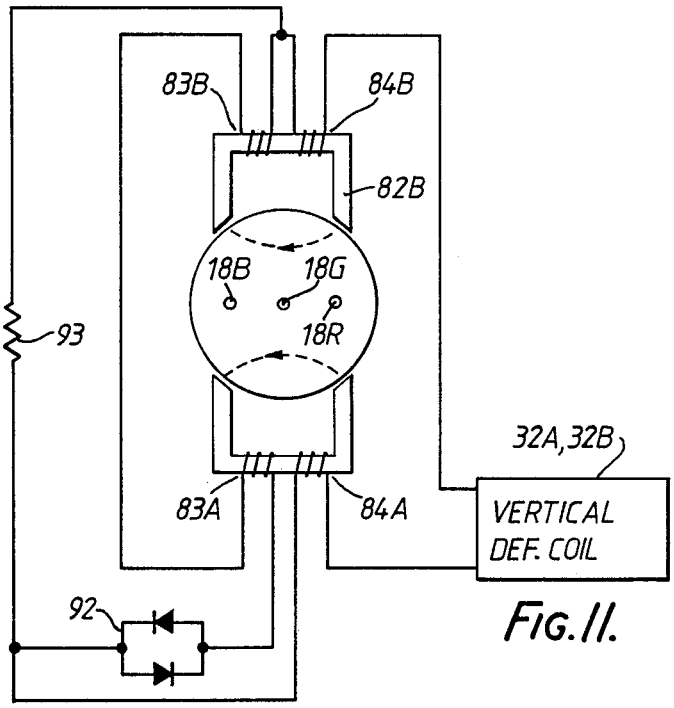
FIG. 11 is a diagram of a component configuration illustrating still another embodiment of the present invention.

FIG. 11 shows a fourth embodiment of the present invention. In FIG. 11, two pairs of sub-coils 83A and 84A, and 83B and 84B are coiled in a direction identical to each other around the U-shaped cores 82A and 82B disposed in a vertical direction. The sub-coils 83A and 83B of the respective cores 82A and 82B are connected in series. A current control element 92, that consists of a pair of diodes connected in inverse-parallel relation, is connected through a resistor 93 to the series circuit of the sub-coils 83A and 83B. In other words, the resistor 93 is connected between one end of the current control element 92 and the junction point of the series-connected sub-coils 83B and 84B. Even with this configuration, the same advantages those the described above can be achieved. In place of the sub-coils coiled around the U-shaped core, there may be disposed sub-coils coiled around an E-shaped core that generate a hexagonal-pole magnetic field.

Furthermore, such nonlinear current control elements as a pair of diodes, a pair of zenor diodes, all connected in inverse-series and a transistor may be used as the current control element in the above-mentioned respective embodiments.

Moreover, the present invention can be similarly applied even to the case of the saddle-type of the vertical deflection coils in addition to the toroidal-type thereof.

As described above, according to the present invention, such phenomena as excessive corrections or insufficient corrections of vertical direction coma errors in the vicinity of the intermediate portion of vertical axis can be substantially eliminated. Therefore, a new and improved color picture tube provided with deflection systems having preferable convergence characteristics can be obtained, thereby eliminating shear in color on the screen.

We claim:

1. A color picture tube apparatus, comprising:

a color picture tube including an envelope with a panel therein, a phosphor screen disposed inside the panel, and an in-line type electron gun generating a center beam and a pair of side beams for exciting the phosphor screen to emit light; and defelection means generating horizontal and vertical deflection magnetic fields for deflecting the electron beams from the electron gun to form respective rasters, the deflecting means including means for generating a barrel type vertical deflection magnetic field and non-linear magnetic field correction means for generating an additional pincushion type magnetic field added to the vertical deflection magnetic field for vertically adjusting the position of the rasters produced by the side beams to the position of the raster produced by the center beam.

2. A color picture tube apparatus according to claim 1, wherein said correction means includes two connected pairs of sub-coils for generating correction magnetic fields in the vertical direction, a first pair of the sub-coils disposed in a vertical direction substantially perpendicular to the plane of the gun, a second pair of the sub-coils disposed in a horizontal direction substantially parallel to the plane of the gun, and a current control element connected to at least one pair of said two pairs of sub-coils for nonlinearly controlling the current flowing into said connected pair of sub-coils.

3. A color picture tube apparatus according to claim 2, wherein said current control element is connected in parallel with at least one of said first and second pairs of sub-coils and includes a pair of diodes connected in inverse-parallel relation.

4. A color picture tube apparatus according to claim 2, wherein said current control element is connected in parallel with at least one of said first and second pairs of sub-coils and includes a pair of zener diodes in inverse-series relation.

5. A color picture tube appratus according to claim 2, further comprising a resistor connected in parallel with a series circuit of one of said sub-coils and said current control element.

6. A color picture tube apparatus according to claim 1, wherein said non-linear magnetic field correction means includes first and second pairs of sub-coils wound around a common core and disposed in a horizontal direction substantially parallel to a plane of the electron gun, and a current control element connected to at least one pair of said first and second sub-coils for non-linearly controlling the current flowing into said connected pair of sub-coils.

7. A color picture tube apparatus according to claim 6, wherein the first pair of sub-coils are wound in a direction opposite to that of the second pair of sub-coils, and a parallel circuit of first pair of sub-coils and the current control element is electrically connected to the second sub-coils in series relation.

8. A color picture tube appratus according to claim 6, further comprising a resistor connected in parallel with a series circuit of one of said sub-coils and said current control element.

9. A color picture tube apparatus according to claim 8, wherein the first pair of sub-coils are wound in same direction as the second pair of sub-coils.

10. A color picture tube apparatus comprising:

a color picture tube including an envelope with a panel therein, a phosphor screen disposed inside the panel, and an in-line type electron gun generating a center beam and a pair of side beams for exciting said phosphor screen to emit light;

deflection means including including first deflection means for generating a pin-cushion type horizontal defelection magnetic field to deflect the electron beams in a horizontal direction, and second deflection means for generating a barrel type vertical deflection magnetic field to deflect the electron beams in a vertical direction;

deflection magnetic field correction means including two pairs of sub-coils for generating a nonlinear correction magnetic field for vertically adjusting the position of the rasters produced by the side beams to the position of the raster produced by the center beam;

deflection current supplying means including first deflection current supplying means electrically connected to the first deflection means to supply first deflection current to the first deflection means and second deflection current supplying means electrically connected to both of the second deflection means and deflection magnetic field correction means to supply second deflection current to both of the second deflection means and deflection magnetic field correction means; and means for nonlinearly adjusting the current in said correction means in accordance with the deflection current in the vertical direction.

11. A color picture tube apparatus according to claim 10, wherein the non-linear adjusting means includes means for increasing the amount of current in the correction means in accordance with an increase of said deflection current in the vertical direction.

12. A color picture tube apparatus according to claim 10, wherein the adjusting means includes a current control element.

13. A color picture tube apparatus according to claim 12, wherein the current control element includes a pair of diodes connected in inverse-parallel.

14. A color picture tube appratus according to claim 12, wherein said current control element includes a pair of zener diodes 15. A color picture tube appratus according to claim 10, wherein the two pairs of sub-coils of said deflection magnetic field correction means comprises a first pair of sub-coils for generating a pin-cushion type correction magnetic field disposed in a vertical direction substantially perpendicular to the plane of the electron gun and a second pair of sub-coils for generating a barrel type correction magnetic field disposed in a horizontal direction substantially parallel to the plane of the electron gun.

16. A color picture tube appratus according to claim 10, wherein the two pairs of sub-coils of said deflection magnetic field correction means comprises a first and second pairs of sub-coils, one pair of which generates a pin-cushion type correction magnetic field and is wound around a common core disposed in a vertical direction substantially perpendicular to the plane of the electron gun.

* * * * *

UNITED STATES PATENT AND TRADEMARK OFFICE

CERTIFICATE OF CORRECTION

PATENT NO. : 4,818,919

DATED : April 04, 1989

INVENTOR(S) : Kenichi Kobayashi et al.

It is certified that error appears in the above-identified patent and that said Letters Patent is hereby corrected as shown below:

Claim 10, column 9, line 11, change "including including" to --including--.

Signed and Sealed this

First Day of December, 1992

*Attest:*

*Attesting Officer*

DOUGLAS B. COMER

*Acting Commissioner of Patents and Trademarks*